US005808587A

United States Patent [19]

Shima

[11] Patent Number: 5,808,587

[45] Date of Patent: Sep. 15, 1998

[54] WIRELESS ACCESS CONTROL SYSTEM USING A PROXIMITY MEMBER AND ANTENNA EQUIPMENT THEREFOR

[75] Inventor: Hiroshi Shima, Tokyo, Japan

[73] Assignee: Hochiki Corporation, Tokyo, Japan

[21] Appl. No.: 823,011

[22] Filed: Mar. 21, 1997

Related U.S. Application Data

[63] Continuation of Ser. No. 407,713, Mar. 21, 1995, abandoned.

[30] Foreign Application Priority Data

Mar. 24, 1994 [JP] Japan ..... 6-053388

[51] Int. Cl.[6] ..... H01Q 1/36

[52] U.S. Cl. ..... 343/895; 340/825.31

[58] Field of Search ..... 343/700 MS, 895; 340/572, 825.31, 825.69; H01Q 1/36

[56] References Cited

U.S. PATENT DOCUMENTS

| | | | |
|---|---|---|---|
| 3,017,633 | 1/1962 | Marston et al. | 343/895 |
| 3,045,237 | 7/1962 | Marston | 343/895 |
| 3,055,003 | 9/1962 | Marston et al. | 343/895 |
| 3,508,269 | 4/1970 | Snyder | 343/895 |
| 3,656,168 | 4/1972 | Stropki | 343/895 |
| 3,956,732 | 5/1976 | Phelan et al. | 343/895 |
| 4,476,459 | 10/1984 | Cooper et al. | 340/572 |
| 4,658,264 | 4/1987 | Baker | 343/895 |
| 4,700,179 | 10/1987 | Fancher | 340/572 |
| 4,736,207 | 4/1988 | Siikarla et al. | 343/895 |
| 4,745,401 | 5/1988 | Montean | 343/895 |
| 5,206,657 | 4/1993 | Downey . | |

FOREIGN PATENT DOCUMENTS

| | | | |
|---|---|---|---|
| 0427342 | 11/1990 | European Pat. Off. . | |
| 0547563 | 12/1992 | European Pat. Off. . | |
| 0556910 | 2/1993 | European Pat. Off. . | |
| 0581206 | 7/1993 | European Pat. Off. . | |
| 3820248 | 1/1989 | Germany . | |
| 4027491 | 3/1992 | Germany . | |
| 56-108189 | 8/1981 | Japan | G08B 15/00 |
| 58-121495 | 7/1983 | Japan | G08B 13/24 |
| 248829 | 2/1990 | Japan | H04B 1/034 |
| 4261981 | 9/1992 | Japan | E05B 49/00 |
| 4357752 | 12/1992 | Japan | 340/825.31 |
| 5019047 | 1/1993 | Japan | 340/825.31 |
| 5143820 | 6/1993 | Japan | 340/825.31 |

*Primary Examiner*—Donald T. Hajec
*Assistant Examiner*—Tho Phan
*Attorney, Agent, or Firm*—Sughrue, Mion, Zinn, Macpeak & Seas, PLLC

[57] ABSTRACT

The present invention provides an antenna equipment for a wireless access control system, which includes a plurality of print substrates which are stacked in a unitary assembly; and a plurality of coil patterns each of which has a starting end and a terminating end, the patterns being respectively formed on the plurality of print substrates; wherein each of the plurality of coil patterns are connected each other at at least one of the starting end and the terminating end thereof.

8 Claims, 6 Drawing Sheets

WIRELESS ACCESS CONTROL SYSTEM USING A PROXIMITY MEMBER AND ANTENNA EQUIPMENT THEREFOR

This is a continuation of application Ser. No. 08/407,713, filed Mar. 21, 1995, abandoned.

BACKGROUND OF THE INVENTION

1. Field of the Invention

The present invention relates to a control system including antenna equipment which supplies operating power to a proximity member in addition to transmitting signals to or receiving them from the proximity member.

2. Description of the Conventional Art

A "wireless access control" system has recently been commercialized. In the wireless access control system, a proximity card carried by a user is accessed by a surveillance control unit installed at the gate of a building or the like, and information such as personal data on the user or user's identity is read wirelessly to effect a certain control such as on-off control to lock or unlock the door of a room. The proximity card used in the wireless access control system is available in two types, one with a built-in power supply and the other without any power supply. In an access control system using the proximity cards with the built-in power supply, the surveillance control unit issues a radio signal to the card to give an access command, and then waits for a response from the card. In addition, since the communication distance from the proximity card to the surveillance control unit is about one meter, only a small amount of power is needed to transmit the radio signal from the surveillance control unit. In an access control system using a proximity card without any power supply, the surveillance control unit produces an inductive electromagnetic field, which is received by the coil of the signal reception antenna on the proximity card and the voltage induced in the coil is rectified to create operating power (this process is called "magnetic coupling"). This system offers the advantage of eliminating the need for battery replacement in the proximity card.

The antenna in the latter surveillance control unit is used not only for transmitting or receiving signals but also for supplying operating power to the proximity card. When signals are transmitted to or received from the proximity card using the FSK modulation protocol, the operating frequency is typically on the low order of several hundred KHz, and the communicable distance over which the proximity card is effectively operable is approximately one meter.

A known version of the wireless access control system using the proximity card without any power supply is disclosed in Unexamined Japanese Patent Publication No. Hei. 4-261981. The proximity card without any power supply has the advantage of eliminating the need for battery replacement and, hence, its applicability to other systems such as unattended ticket gates at railway stations that check commuter's pass and tollgates along toll road is under review.

The antenna in the surveillance control unit that supplies power to proximity cards without any power supply is usually fabricated by operators who use their own hand to wind copper wires around bobbins to form antenna coils. Namely, the coil of the antenna is handmade coil. Since the matching of antenna coils is variable with the manner of winding copper wires, not only great skill but also fine adjustment have to be needed.

Also known in the art is a security system in which a small tag is attached to an item for sale in a store so that if someone attempts to take it without clearing through the cashier, the tag receives a radio signal issued from the antenna at the gate and sends back a response signal to signal an alarm so as to protect against theft (see Unexamined Japanese Patent Publication No. Sho 58-121495).

Additionally, a radio transmitter/receiver is known that forms a pattern on a printed-circuit substrate to form an antenna for transmitting or receiving electric waves (see Unexamined Japanese Patent Publication Hei 2-48829).

On the other hand, theoretically, the strength of the inductive electromagnetic field for supplying operating power from the antenna equipment to the proximity card attenuates in proportion to the third power of the distance between the antenna equipment and the proximity card and, in actual measurements, the proportionality constant is the fourth power of the distance. In order to insure that the antenna produces a sufficient inductive electromagnetic field to supply power, the antenna have to be configured to permit a maximum flow of high-frequency current while supplying it with a sufficient transmission power that matches the communicable distance.

Although the antenna coil formed by winding a copper wire around a bobbin can transmit an electromagnetic wave to operate the proximity card, a winding is not only costly but also cumbersome in performing adjustments. In addition, in the antenna equipment using a printed-circuit substrate, it is possible to transmit data by a radio wave. However, the antenna equipment suffers a substantial loss due to the resistance of the conductor in the coil pattern formed on the printed-circuit substrate and the resulting drop in the radiation efficiency of the antenna makes it impossible to assure the assumed communicable distance because the electromagnetic wave for operating the proximity card can not be adequately transmitted. This may be more specifically explained as follows. The radiation efficiency of the antenna is determined by sharpness Q. The antenna is usually comprised of a coil component L, a tuning capacitor C and a conductor resistance R forming an LCR series resonant circuit which helps maximize the high-frequency current flowing through the antenna. The sharpness Q of an antenna at an operating frequency f (Hz) is expressed by:

$$Q=1/w_0\mathrm{CR}\ (w_0=2\pi f)$$

$$Q=w_0L/R$$

Thus, the sharpness Q is in inverse proportion to the resistance component R of the antenna conductor. Additionally, the skin effect of high-frequency currents substantially increases the conductor resistance R. Hence, the increasing conductor resistance R lowers the sharpness Q to eventually reduce the radiation efficiency of the antenna. To compensate for this decrease, the transmission power has to be increased but then problems occur such as higher power consumption, larger circuits and higher costs. In addition, in the access system or the like, the frequency band in the range of 100 to 130 KHz is preferably used to take measures to meet the noise.

SUMMARY OF THE INVENTION

It is an object of the present invention to provide a wireless access system which has an antenna equipment assuring a sufficiently high value of sharpness Q to give high radiation efficiency and a sufficiently wider communicable area so as to reduce the transmission power, and a proximity member without a battery.

It is another object of the present invention is to provide antenna equipment for the wireless access system having high radiation efficiency that is suitable for use with a control system that supplies a proximity member with operating power by radio transmission so as to read information from the proximity member so as to typically control to lock or unlock doors, protecting against a theft or the like.

In order to accomplish the above object of the present invention, an antenna equipment of the present invention for wireless access control system using a proximity member is comprised of a plurality of printed-circuit substrates which are stacked in a unitary assembly; and a plurality of coil patterns each of which has a starting end and a terminating end, the patterns being respectively formed on the plurality of insulating printed-circuit substrates; wherein each of the plurality of conductive coil patterns are connected each other at at least one of the starting end and the terminating end thereof.

According to the structure of the antenna equipment of the present invention, conductor resistances of the respective antenna patterns are connected in parallel. Therefore, the equivalent conductor resistance as viewed from the power supply terminals to the antenna is reduced significantly and a sufficient level of sharpness Q is insured to provide high radiation efficiency for the antenna.

Further, in order to accomplish another object of the present invention, a wireless access control system of the present invention using a proximity member is comprised of a controlled body which is controlled by the control system; a control apparatus for controlling the control system; a proximity member having: a memory for storing ID information therein, first transmitting/receiving device for receiving a signal having a predetermined frequency and transmitting a signal based on the ID information stored in the memory in response to the signal having the predetermined frequency; and power supply unit for creating a operation power of the proximity member by receiving the signal having the predetermined frequency; reading/writing apparatus having: second transmitting/receiving device for transmitting the signal having the predetermined frequency and receiving the signal based on the ID information transmitted from the proximity member, the second transmitting/receiving device including an antenna having a plurality of printed-circuit substrates which are stacked in a unitary assembly, and a plurality of coil patterns each of which has a starting end and a terminating end, the patterns being respectively formed on the plurality of insulating print substrates, wherein each of the plurality of conductive coil patterns are connected each other at at least one of the starting end and the terminating end thereof; controller for controlling the controlled body based on the ID information received by the second transmitting/receiving device; and transmission unit for transmitting an operation condition of the reading/writing apparatus to the control apparatus; and transmission path which connects the control apparatus and the reading/writing apparatus; wherein the proximity member picks up the signal having the predetermined frequency to acquire the operation power when the proximity member enters an area where communication with the reading/writing apparatus is possible, and the signal having the predetermined frequency is an inductive electromagnetic field from said antenna.

According to the wireless control system of the present invention, only a small transmission power insures an "effective" communication area which guarantees signal transmission and reception within a certain distance (one meter for example) while establishing an inductive electromagnetic field for supplying operating power. Since such an advantage is achieved by stacking a plurality of thin printed-circuit substrates, the size and thickness of the antenna equipment can be sufficiently reduced to realize an access control system or a security system that has the antenna equipment built in the door of a room or hung on the surface of a wall. Further, the proximity card does not need a battery so that the replacement of a battery is not necessary and the weight of the proximity card is lighter than that of a card in which the battery is held.

DESCRIPTION OF THE PREFERRED EMBODIMENTS

The preferred embodiments of the present invention will be described referring to the accompanying drawings as follows.

Figure 1:
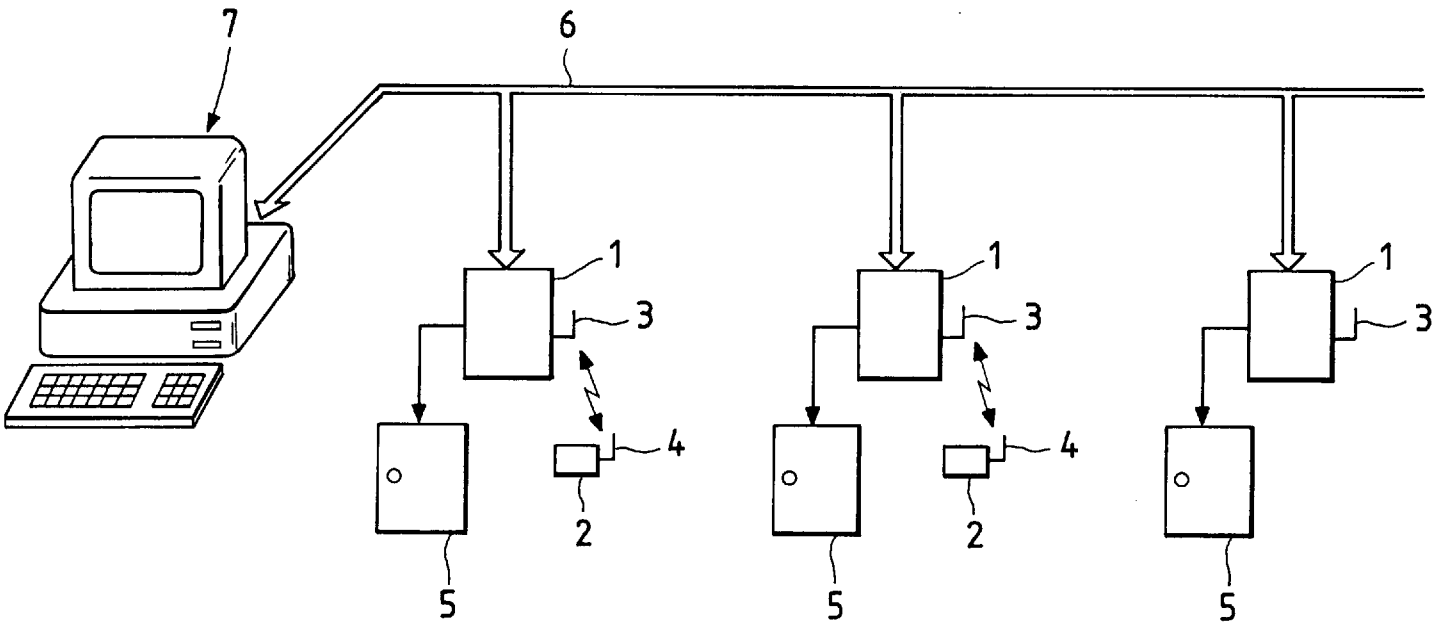
FIG. 1 is an illustration of a door locking or unlocking system using an antenna equipment of the present invention.

FIG. 1 is a explanation view of a door locking or unlocking system having an antenna equipment of the present invention. Referring to FIG. 1, a reader/writer 1 is installed in one-to-one correspondence to the rooms which are controlled in locking or unlocking. Each reader/writer 1 is fitted with the antenna equipment 3 of the present invention, which supplies operating power in wireless to the card antenna 4 on a proximity card 2 carried by the user of the associated room. The reader/writer 1 also transmits signals to and receives them from the card antenna 4 in wireless.

A memory in the proximity card 2 contains personal or ID information specific to the user and is activated upon receiving operating power supplied under the inductive electromagnetic field from the antenna equipment 3 in the reader/writer 1. In response to a READ command from the reader/writer 1, the personal or ID information stored in the memory is read and transmitted to the reader/writer 1. The reader/writer 1 checks the personal or ID information that is read from the proximity card 2 to see if it matches the reference data, and, if the result is positive, it unlocks the electronic key on the door 5.

The reader/writer 1 locks the key again when the user has entered or left his or her room or when a specified time has passed after the key was unlocked. In this embodiment, a plurality of reader/writers 1 are connected to a remote control unit 7 via a transmission path 6 so that the data on all events of entrance to and exit from each room using reader/writers 1 are transferred to the remote control unit 7 for control purposes.

Figure 2:
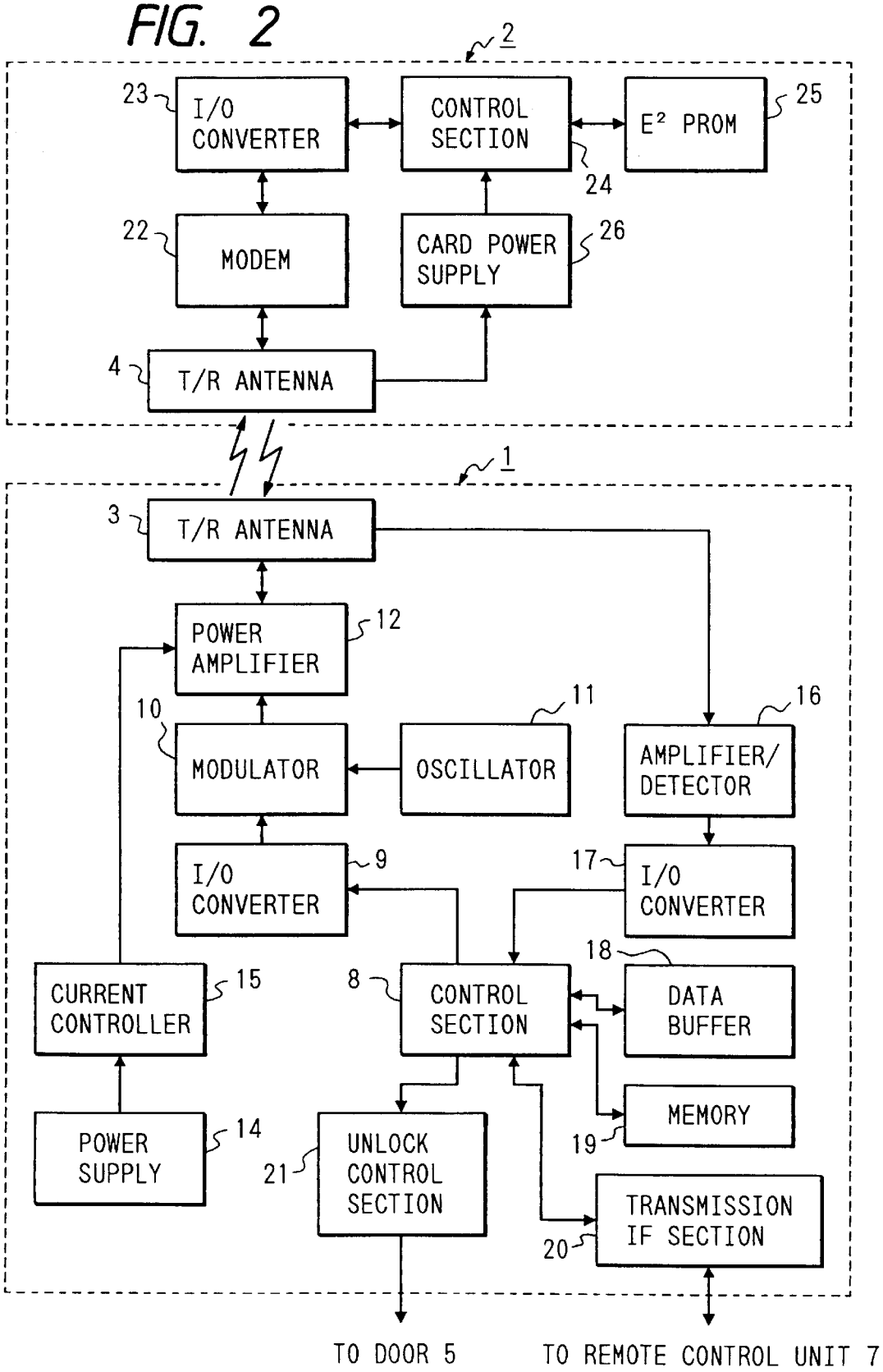
FIG. 2 is a block diagram showing an example of each of a proximity card and a reader/writer used in the system shown in FIG. 1.

FIG. 2 is a block diagram showing an example of the reader/writer 1 and the proximity card 2 shown in FIG. 1. Referring to FIG. 2, the reader/writer 1 is connected to a control section 8 connected to a data buffer 18 and a memory 19 containing an address setting part and the like. The control section 8 is also connected to the following components of a signal transmission section: an I/O converter 9 for parallel-series conversion, a modulator 10, an oscillator 11, a power amplifier 12, and a signal transmitting/receiving antenna 3 that is implemented by the antenna equipment of the present invention.

The power amplifier 12 is connected to a power supply 14 and a current controller 15. The signal transmitting section has predetermined frequencies f1 and f2 that correspond to data bits 0 and 1, respectively, from the control section 8 and it performs FSK modulation in such a way that the signal to be transmitted is converted to frequency f1 in response to bit 0 and to frequency f2 in response to bit 1. At normal standby, the control section 8 supplies the modulator 10 with a fixed output of either bit, say bit 0, via the I/O converter 9.

According to this arrangement, the modulator 10 supplies the power amplifier 12 with a signal of frequency f1 in response to bit 0 from the oscillator 11 and normally transmits the frequency signal f1 from the transmitting/receiving antenna 3. Therefore, upon entering the area where communication with the reader/writer 1 is possible, the proximity card 2 picks up the signal of frequency f1 to acquire the operating power.

The reader/writer 1 has an amplifier/detector 16 and an I/O converter 17 for series-to-parallel conversion in the signal receiving section so that an FSK signal transmitted from the proximity card 2 is modulated and supplied as reception data to the control section 8. The control section 8 is also connected to a transmission IF section 20 that exchanges data with the remote control unit 7 and to an unlock control section 21 that performs control over the electronic key in the door 5.

The proximity card 2 is provided with a transmitting/receiving antenna 4, a MODEM 22, and I/O converter 23, a control section 24, an $E^2$ PROM 25 as a nonvolatile memory, and a card power supply 26. The antenna 4 receives a signal sent from the reader/writer 1 and outputs the received signal to the MODEM 22 and the card power supply 26. The card power supply 26 rectifies the reception voltage at the antenna and creates a line voltage to the respective circuit parts.

MODEM 22 demodulates the received FSK signal into data bits while transmitting data bits after modulating them into an FSK signal. It should be noted here that the proximity card 2 may transmit data bits as such without performing FSK modulation. The I/O converter 23 converts the received series data bits to parallel data before they are supplied to the control section 24; conversely, the parallel data from the control section 24 are converted to series data by the I/O converter 23 before they are delivered to the MODEM 22.

The control section 24 decodes a command from the reader/writer 1 and writes data into or reads them from $E^2$ PROM 25. The proximity card 2 typically stores personal or ID information in advance, the reader/writer 1 gives a READ command in normal use, and in response to this READ command, the control section 24 reads the stored personal or ID information from the $E^2$ PROM 25 and transmits it to the reader/writer 1.

Figure 3A:
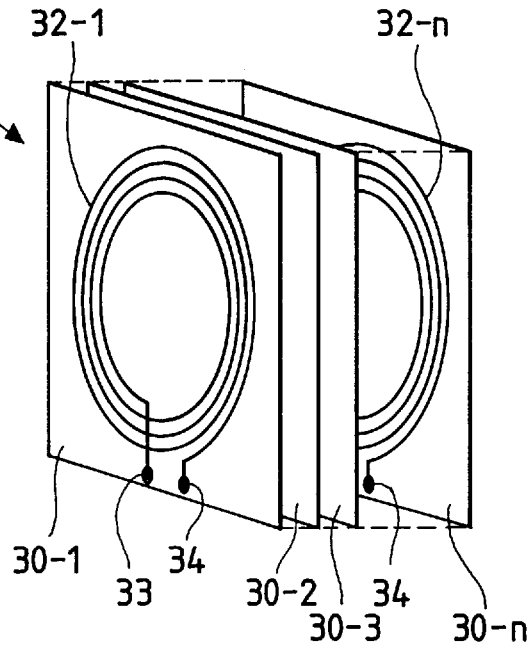
FIGS. 3A, 3B, 3C, 3D and 3E illustrate a first embodiment of the antenna equipment of the present invention.
Figure 3B:
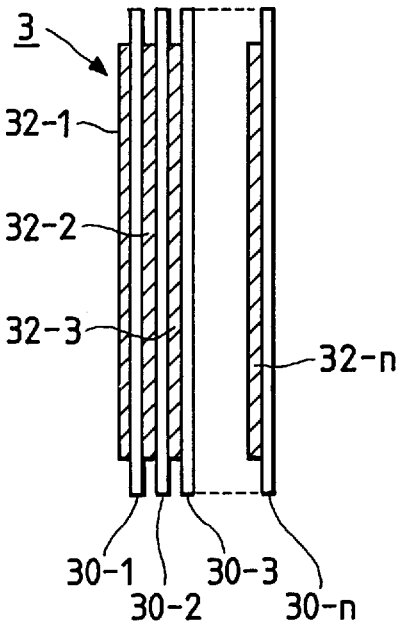

FIG. 3A shows the antenna equipment of the first embodiment of the present invention, and FIG. 3B is a side view of the antenna equipment. As shown in the drawings, the antenna equipment of the invention is comprised of a plurality of thin printed-circuit substrates 30-1 to 30-n having similar spiral coil patterns 32-1 to 32-n formed thereon. The thickness of the printed-circuit substrate is in the range of 1.6 mm to 2.0 mm. Further, the print-substrate is preferably made of glass epoxy, that is, epoxy resin including glass fiber therein. The starting ends of the spiral coil patterns 32-1 to 32-n are drawn out of the respective coils to form through-holes 33 at the lower edges of the printed-circuit substrates; in the same manner, the terminating ends of the spiral coil patterns are drawn out of the respective coils to form through-holes 34 at the lower edges of the printed-circuit substrates. Namely, respective printed-circuit substrates are insulated each other except the through holes 33 and 34.

The printed-circuit substrates 30-1 to 30-n having the spiral coil patterns 32-1 to 32-n thus formed thereon are stacked in a unitary assembly as shown in FIG. 3B, whereupon the adjacent through-holes 33 (or 34) contact successively to form a common terminal for supplying power to the antenna. Thus, the spiral coil patterns 32-1 to 32-n are connected in parallel as seen from the pair of power supply terminals which is formed by connecting the through-holes 33 (or 34) together. Here, FIG. 3D is a partial enlarged view of FIG. 3A, and FIG. 3E is a sectional view of I-I' line in FIG. 3D. For example, the starting end of the spiral pattern 32-1 as shown in FIG. 3D has a shape shown in FIG. 3E. Also, the starting ends of the spiral pattern 32-2 and the other spiral patterns (not shown) have the same shape as that of the spiral pattern 32-1 so that the printed-circuit substrates are stacked successively to connect the through-holes together to form the common terminal for supplying power to the antenna. Namely, printed circuit print substrate is made of a insulating material so that the spiral coil patterns made of conductive material are insulated from each other by the print substrates. Accordingly, the respective spiral coil patterns are connected through merely the through-holes to each other.

Figure 3C:
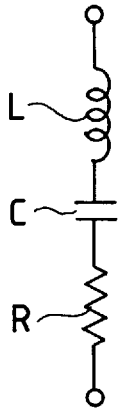
Figure 3D:
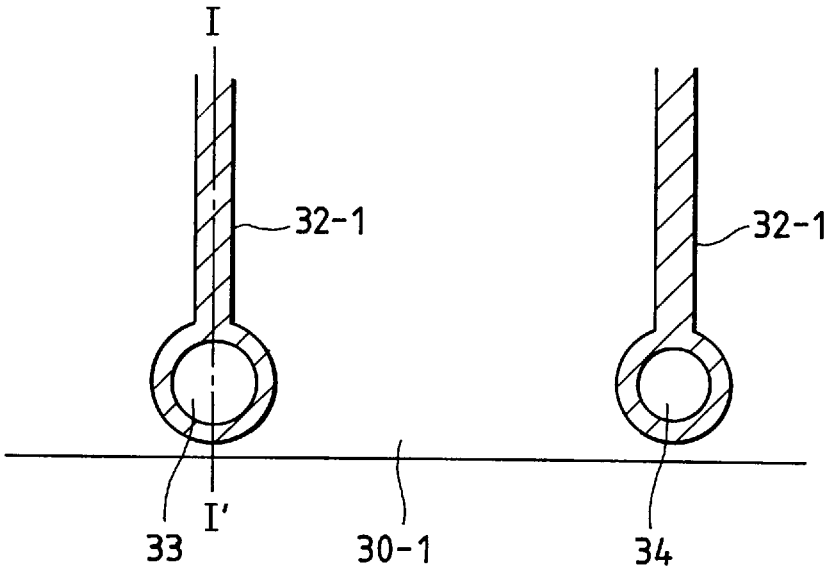
Figure 3E:
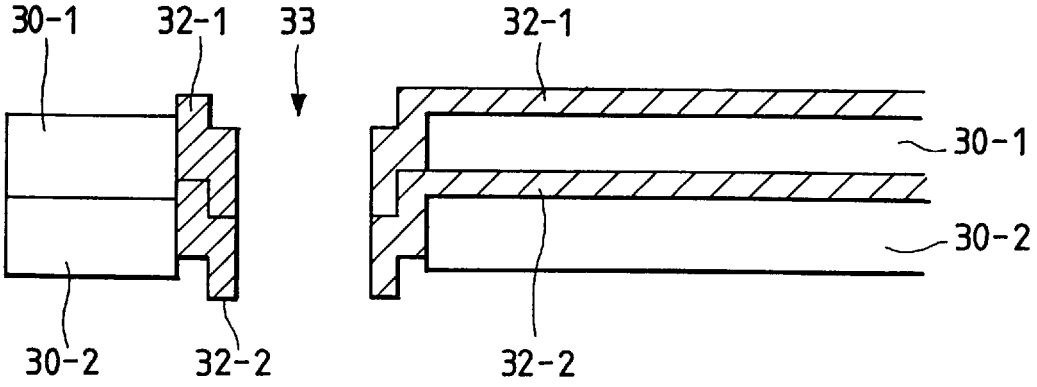

FIG. 3C shows the LCR resonant circuit as formed by the antenna equipment of the invention. The coil component L of this resonant circuit is the parallel sum of the coil components of the parallel-connected spiral coil patterns 32-1 to 32-n. The capacitance C is realized by the capacitor provided for antenna matching and adjusting. Additionally, the resistance component R is the parallel-resistance value of the conductor resistances of the spiral coil patterns 32-1 to 32-n which are connected in parallel to the common power supply terminals. The parallel-resistance value R is given by: $R=r/n$ (where r is the resistance of an individual conductor and n is the number of coil patterns). Therefore, compared to the case where a spiral coil is formed on a single printed-circuit substrate, the conductor resistance can be reduced in accordance with n, or the number of layers in which the coils are stacked. Thus, the sharpness Q of the antenna can be sufficiently increased to enhance the radiation efficiency of the antenna.

Figure 4:
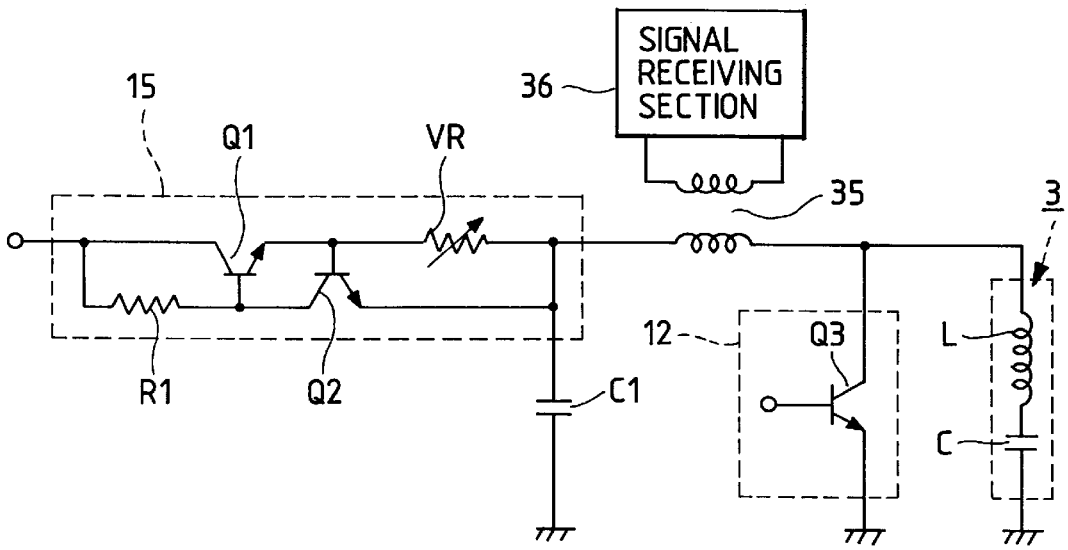
FIG. 4 shows an exemplary drive circuit for the antenna equipment of the present invention.

FIG. 4 shows an exemplary circuit for the signal transmitting section shown in FIG. 2 for driving the antenna equipment of the invention. Referring to FIG. 4, a line voltage +V from the power supply passes through the current controller 15, a coupling coil 35 for coupling to a signal receiving section 36 and the power amplifier 12 to be supplied to the antenna equipment 3 of the invention. In FIG. 4, the antenna equipment 3 is shown to consist of only the coil component L and the matching capacitor C, with the conductor resistance R being omitted.

The current controller 15 is provided with transistors Q1 and Q2, a resistor R1 and a current limiting variable resistor VR. Capacitor C1 is provided to stabilize the power being supplied to the antenna equipment 3. During signal transmission, the primary winding of the coupling coil 35 works as a choke coil for the rf current being supplied to the antenna equipment 3 and, during signal reception, the coil 35 works to couple the reception voltage being induced in the antenna equipment 3.

The current controller 15 detects the supply current by means of variable resistor VR, controls the bias voltage of transistor Q1 by means of transistor Q2 and limits the current to the value determined by variable resistor VR. The power amplifier 12 has a power transistor Q3 which is driven by a signal of frequency f1 or f2 supplied from modulator 10 in FIG. 2 to supply the antenna equipment 3 with the rf current of frequency f1 or f2. The transmission power from the antenna equipment 3 can be adjusted as appropriate by determining the value of current limitation by variable resistor VR in the current controller 15.

Figure 5A:
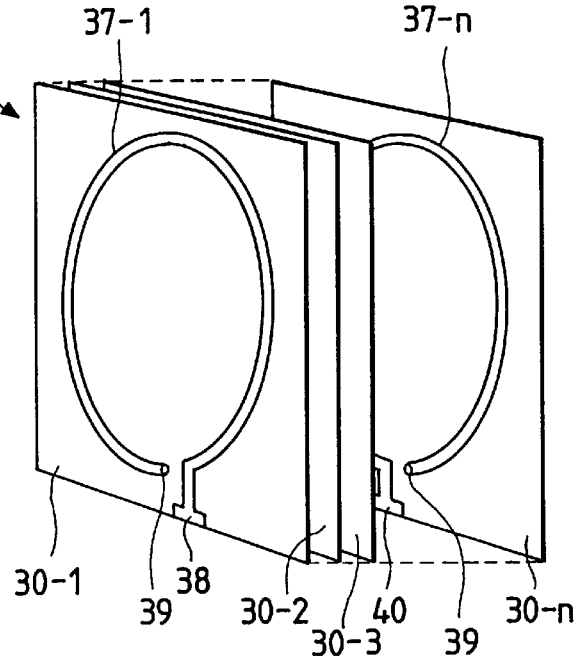
FIGS. 5A, 5B and 5C illustrate a second embodiment of the antenna equipment of the present invention.

FIG. 5A illustrates a second embodiment of the antenna equipment of the invention. As shown in FIG. 5A, the antenna equipment of the second embodiment is provided with a plurality of printed-circuit substrates 30-1 to 30-n having loop patterns 37-1 to 37-n each having a length of approximately one turn, the length being slightly shorter than one turn. Loop pattern 37-1 located on one side has a power supply terminal 38 to the antenna and a through-hole 39 formed at opposite ends of the loop pattern whereas loop pattern 37-n located on the other side has a power supply terminal 40 to the antenna and a through-hole 39. The intermediate loop patterns 37-2 to 37-(n-1) (not shown) have no parts corresponding to power supply terminals 38 and 40 and, instead, a through-hole is formed at both ends of the loop.

Figure 5B:
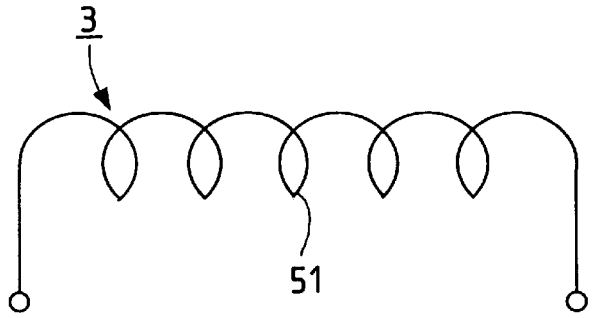

Loop patterns 37-1 to 37-n have the respective through-holes connected in such a way that a spiral coil is formed in the direction in which the printed-circuit substrates 30-1 to 30-n are stacked. Thus, the antenna equipment of the second embodiment which is illustrated in FIG. 5A have the spiral coil 51 which runs as shown in FIG. 5B parallel to the direction in which the printed-circuit substrates 30-1 to 30-n are stacked.

It should also be noted each of the loop patterns 37-1 to 37-n has a sufficiently broad conductor width to insure that the loop patterns will have a reasonably low resistance per unit length. In this embodiment, it is preferable that the width of the loop pattern is more than 2 mm. The antenna equipment of the present invention of the second embodiment having the spiral coil 51 formed along the direction of stacking the printed-circuit substrates can enhance the directivity in the stack direction.

Figure 5C:
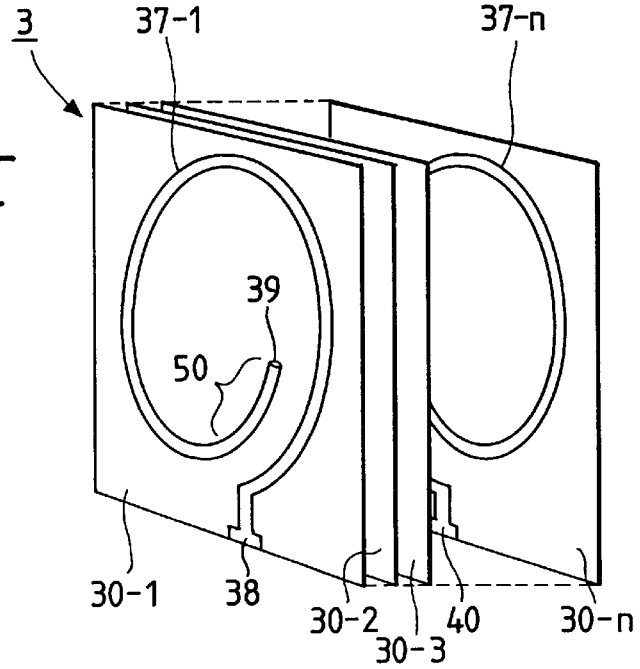

In addition, the loop patterns as described above are slightly shorter than one turn. However, the loop patterns as shown in FIG. 5C being slightly longer than one turn can be applied to the antenna equipment of the present invention. In this antenna equipment, remaining components are similar to that of the antenna equipment as shown in FIG. 5A. In FIG. 5C, an excess length 50 is less than one turn of the loop patterns. Specifically, it is preferable that the excess length 50 is less than one-third of the loop patterns.

Figure 6A:
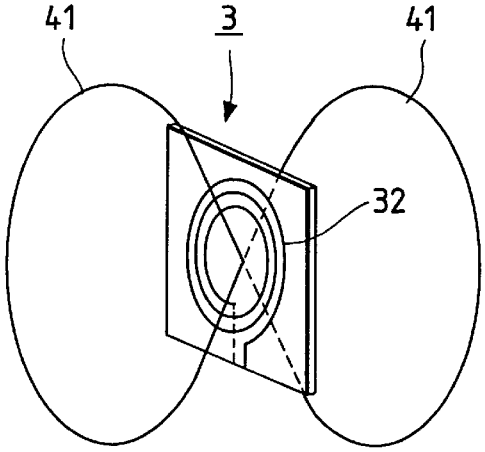
FIGS. 6A and 6B illustrate the directional characteristics of the first and second embodiment of the antenna equipment of the present invention, respectively.
Figure 6B:
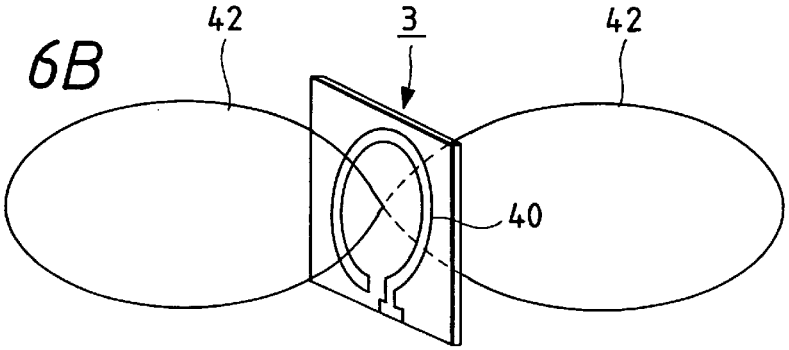

FIG. 6A illustrates the directional characteristic of the first embodiment of the antenna equipment of the present invention which is shown in FIG. 3A, and FIG. 6B illustrates the directional characteristic of the second embodiment of the antenna equipment of the present invention which is shown in FIG. 5A. The antenna equipment shown in FIG. 6A which uses the spiral coil pattern 32 produces a radiation pattern with a comparatively wide direction angle on both lateral sides as indicated by pattern 41. In contrast, the antenna equipment shown in 6B which uses the spiral coil 51 produces a radiation pattern 42 that is enhanced along the direction in which the printed-circuit substrates 30-1 to 30-n are stacked.

In the foregoing embodiments, the antenna equipment of the invention is used in a door locking or unlocking system; however, the invention is by no means limited to this particular case and the antenna equipment is applicable as such to any appropriate systems that read information from or write it into proximity cards as they are supplied with operating power from reader/writers. Namely, the antenna equipment can be applied to such as an unattended ticket gates at railway stations that check commuter's pass, toll-gates along toll road is under review or control systems for parts in a manufacturing line. In addition, the antenna equipment of the present invention can also applied to a security system in which small tag is attached to an item for sale in a store so that if someone attempts to take it without clearing through the cashier, the tag receives a radio signal issued from the antenna at the gate and sends back a response signal to signal an alarm so as to protecting against theft.

Various factors of the antenna equipment such as the shape of patterns to be formed on printed-circuit substrates, their size and the number of printed-circuit substrates to be stacked may also be determined as appropriate for specific situations.

As described on the foregoing, the present invention provides the antenna equipment that uses compact, thin printed-circuit substrates and which hence assures a sufficiently high value of sharpness Q to give high radiation efficiency. Accordingly, the present invention can also provides the wireless access control system capable of assuring a sufficiently wider communicable area than system using a conventional antennas if supplied with the same power and the transmission power is significantly reduced if the communicable area is the same.

The only requirement for the invention is that thin printed-circuit substrates having antenna coil patterns formed thereon should be stacked together in a unitary assembly and, hence, compact, thin antenna equipment that is suitable for installation within doors or on wall surfaces can be fabricated.

Additionally, the use of printed-circuit substrates helps insure high product quality and permits large-scale production of antenna equipment.

What is claimed is:

1. A wireless access control system using a proximity member comprising:

a controlled body which is controlled by said control system;

a remote control unit for controlling said control system;

a proximity member comprising memory means for storing ID information therein, first transmitting/receiving means for receiving a signal having a predetermined frequency and transmitting a signal based on said ID information stored in said memory means in response to said signal having the predetermined frequency; and first power supply means for creating an operation power of said proximity member by receiving said signal having the predetermined frequency to supply said operation power to said proximity member;

a reading/writing unit comprising second transmitting/receiving means for transmitting said signal having the predetermined frequency and receiving said signal based on said ID information transmitted from said proximity member, said transmitting/receiving means including an antenna having a plurality of printed-circuit substrates which are stacked in a unitary assembly, and a plurality of coil patterns each of which has a starting end and a terminating end, said patterns being respectively formed on said plurality of printed-circuit substrates, wherein a starting end and a terminating end of at least one of said plurality of coil patterns are connected to a starting end and terminating end, respectively, of at least one other of said plurality of coil patterns; second power supply means for supplying a power to said antenna so that said antenna generates an inductive electromagnetic field which is the signal having the predetermined frequency; control means for controlling said controlled body based on said ID information received by said second transmitting/receiving means; and transmission means for transmitting an operation condition of said reading/writing unit to said remote control unit; and a transmission path which connects said remote control unit and said reading/writing unit;

wherein said proximity member picks up said signal having the predetermined frequency to acquire said operation power when said proximity member enters an communication area of said reading/writing unit.

2. A control system as claimed in claim 1, wherein at least one of said plurality of coil patterns is a spiral having a plurality of turns.

3. A control system as claimed in claim 2, wherein at least two of said plurality of coil patterns are spirals having a plurality of turns and similar shapes.

4. A control system as claimed in claim 1, wherein each of said plurality of coil patterns has a length of substantially one turn, and wherein a starting end of at least one of said plurality of coil patterns is connected to a terminating end of at least one other of said plurality of coil patterns.

5. A control system as claimed in claim 4, wherein adjacent coil patterns are connected to each other to form a spiral in the stacking direction of said plurality of printed-circuit substrates.

6. A control system as claimed in claim 4, wherein the length of each of said plurality of coil patterns is more than one turn but less than two turns.

7. A control system as claimed in claim 4, wherein each of said plurality of coil patterns has a coil width greater than or equal to 2 mm.

8. A control system as claimed in claim 4, further comprising a plurality of said reading/writing unit.

* * * * *